US009722377B1

(12) United States Patent
Cheng

(10) Patent No.: US 9,722,377 B1
(45) Date of Patent: Aug. 1, 2017

(54) PLUGGABLE POWER SUPPLY DEVICE

(71) Applicant: EDAC POWER ELECTRONICS CO., LTD., Chung Ho, Taipei County (TW)

(72) Inventor: Jen-Jen Cheng, Chung Ho (TW)

(73) Assignee: EDAC POWER ELECTRONICS CO., LTD., Chung Ho, Taipei County (TW)

( * ) Notice: Subject to any disclaimer, the term of this patent is extended or adjusted under 35 U.S.C. 154(b) by 0 days.

(21) Appl. No.: 15/227,964

(22) Filed: Aug. 4, 2016

(51) Int. Cl.

| | |
|---|---|
| ***H01R 29/00*** | (2006.01) |
| ***H01R 31/06*** | (2006.01) |
| ***H01R 13/631*** | (2006.01) |
| *H01R 35/04* | (2006.01) |
| *H01R 27/00* | (2006.01) |

(52) U.S. Cl.
CPC ..... *H01R 31/06* (2013.01); *H01R 13/631* (2013.01); *H01R 27/00* (2013.01); *H01R 35/04* (2013.01)

(58) Field of Classification Search
USPC ..... 439/166, 171–175, 217, 218, 956
See application file for complete search history.

(56) References Cited

U.S. PATENT DOCUMENTS

| | | | | |
|---|---|---|---|---|
| 5,744,934 A * | 4/1998 | Wu | H01R 13/6675 | 307/150 |
| 6,923,667 B1 * | 8/2005 | Chen | H01R 27/00 | 439/172 |
| 6,988,903 B1 * | 1/2006 | Cheng | H01R 31/065 | 439/137 |
| 7,008,246 B2 * | 3/2006 | Zhuge | H01R 13/6272 | 439/131 |

* cited by examiner

*Primary Examiner* — Tho D Ta
(74) *Attorney, Agent, or Firm* — Leong C. Lei

(57) ABSTRACT

Disclosed is a pluggable power supply device. When a pluggable plug is to be in combination with a power supply seat, an insertion portion is first inserted in an accommodation portion of the power supply seat, allowing a second engagement portion to be engaged with a first engagement portion, and causing the gripping device on the power supply seat to be translated horizontally; a sliding block is then moved horizontally to a separation position and drive a first gripping portion on one side of thereof, allowing a second gripping portion to enter the accommodation portion. Thereafter, an elastic element drives the sliding block to translate horizontally to a gripping position, thereby moving the first gripping portion to be engaged with the second gripping portion. When the pluggable plug is to be removed, it can be taken out only by moving the sliding block horizontally.

9 Claims, 9 Drawing Sheets

PLUGGABLE POWER SUPPLY DEVICE

TECHNICAL FIELD OF THE INVENTION

The present invention relates to a pluggable power supply device, and more particularly to a power supply device capable of easy, quick replacement so as to conform to different power supply specifications.

DESCRIPTION OF THE PRIOR ART

To allow electronic equipment to be charged, it is generally to connect a fixed-type plug to the electronic equipment, and the plug is then inserted in a socket to get electricity for it.

However, the specifications of conventional fixed-type plugs and sockets used in countries in the world are not exactly the same such that manufacturers will supply conventional fixed-type plugs conforming to the specifications of sale or use areas depending on the sale or use areas of electronic equipment made thereby.

Nowadays traffic is advanced, and sightseeing travels or business trips abroad are quite a common thing. However, the conventional fixed-type plugs carried may not be connectable to sockets of different countries, resulting in portable electronic equipment (e.g. cellular phone or notebook computer) being unable to be recharged. It is impossible for users to change a portable electronic equipment every time when they arrive in a different country, but purchasing adapters of different specifications conforming to different countries needs spend a lot of money, and they may even not have chance to be used afterwards. In addition, carrying adapters of different specifications to travel around different countries is quite cumbersome and troublesome.

SUMMARY OF THE INVENTION

To overcome the defects mentioned above, the present invention is proposed.

The main object of the present invention is to provide a pluggable power supply device, capable of carrying out the replacement of plugs of different specifications simply and quickly.

To achieve the object mentioned above, the present invention proposes a pluggable power supply device, including a power supply seat and at least one pluggable plug, where one face of the power supply seat is formed with an accommodation portion, on one side wall of which at least one first engagement portion is configured. Furthermore, a gripping device is movably configured on the power supply seat, and includes a sliding block configured in a horizontal translation way in the accommodation portion and positioned on one side face thereof opposite to the first engagement portion, at least one first gripping portion configured on one side of the sliding block adjacent to the first engagement portion and at least on elastic element configured on another side of the sliding block far away from the first gripping portion.

One face of the pluggable plug is configured with an insertion portion formed correspondingly to the accommodation portion, on one side of which at least one second engagement portion is configured, and on another side of which at least one second gripping portion is formed.

When the power supply seat is to be in combination with the pluggable plug, the insertion portion is inserted partially in the accommodation portion, allowing the second engagement portion to be engaged with the first engagement portion and causing the gripping device to be moved horizontally so that the sliding block can be moved horizontally to a separation position to drive the first gripping portion to move and deform the elastic element to store energy. At the same time, the insertion portion is inserted in the accommodation portion completely to allow the second gripping portion to enter the accommodation portion. Thereafter, the elastic element is released to recover the sliding block back to the gripping position through the energy stored therein, allowing the first gripping portion to be engaged with the second gripping portion.

Furthermore, when the pluggable plug is to be removed from the power supply seat, the sliding block is moved horizontally to a separation position, allowing the first gripping portion to be separated from the second gripping portion, and the pluggable plug can ten be removed from the power supply seat freely and easily, thereby facilitating carrying, storage and replacement.

DETAILED DESCRIPTION OF THE PREFERRED EMBODIMENTS

Figure 1:
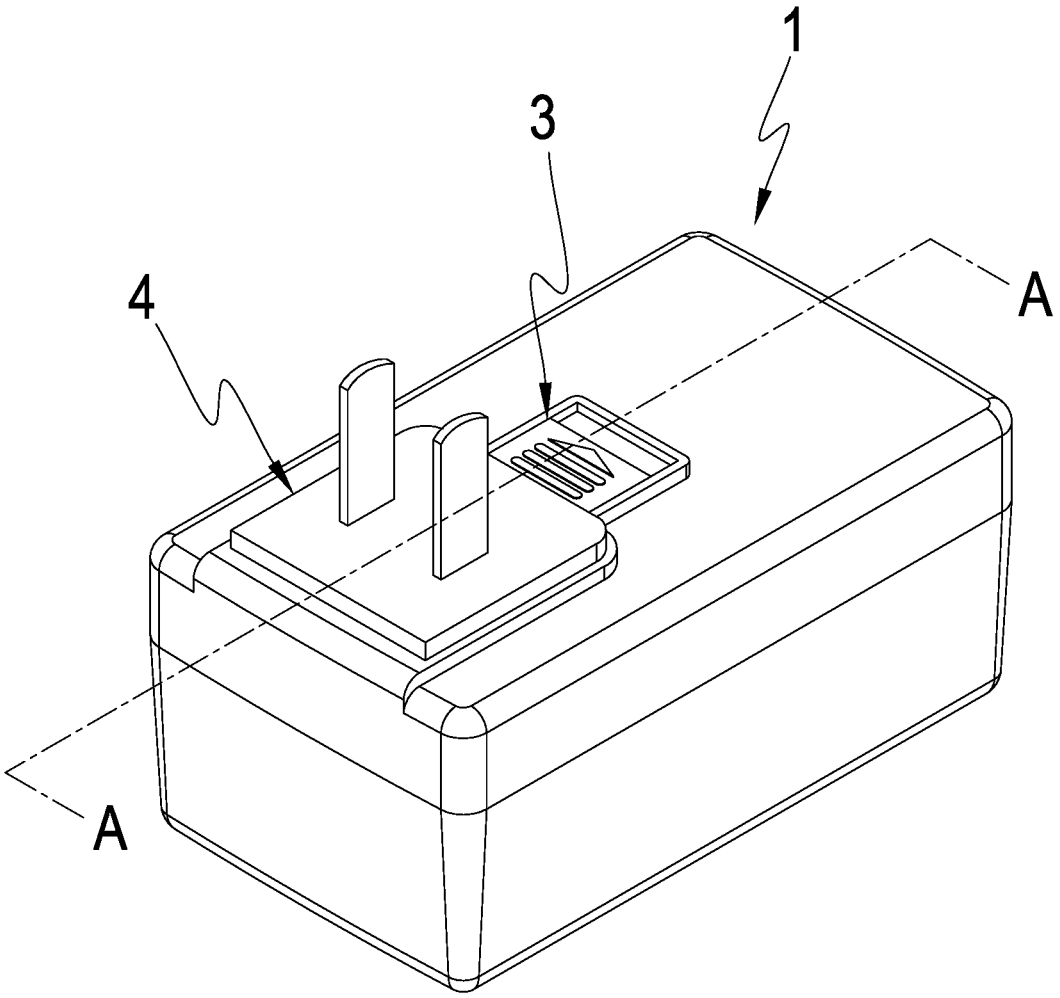
FIG. 1 is a perspective view of a preferred embodiment according to the present invention.
Figure 2:
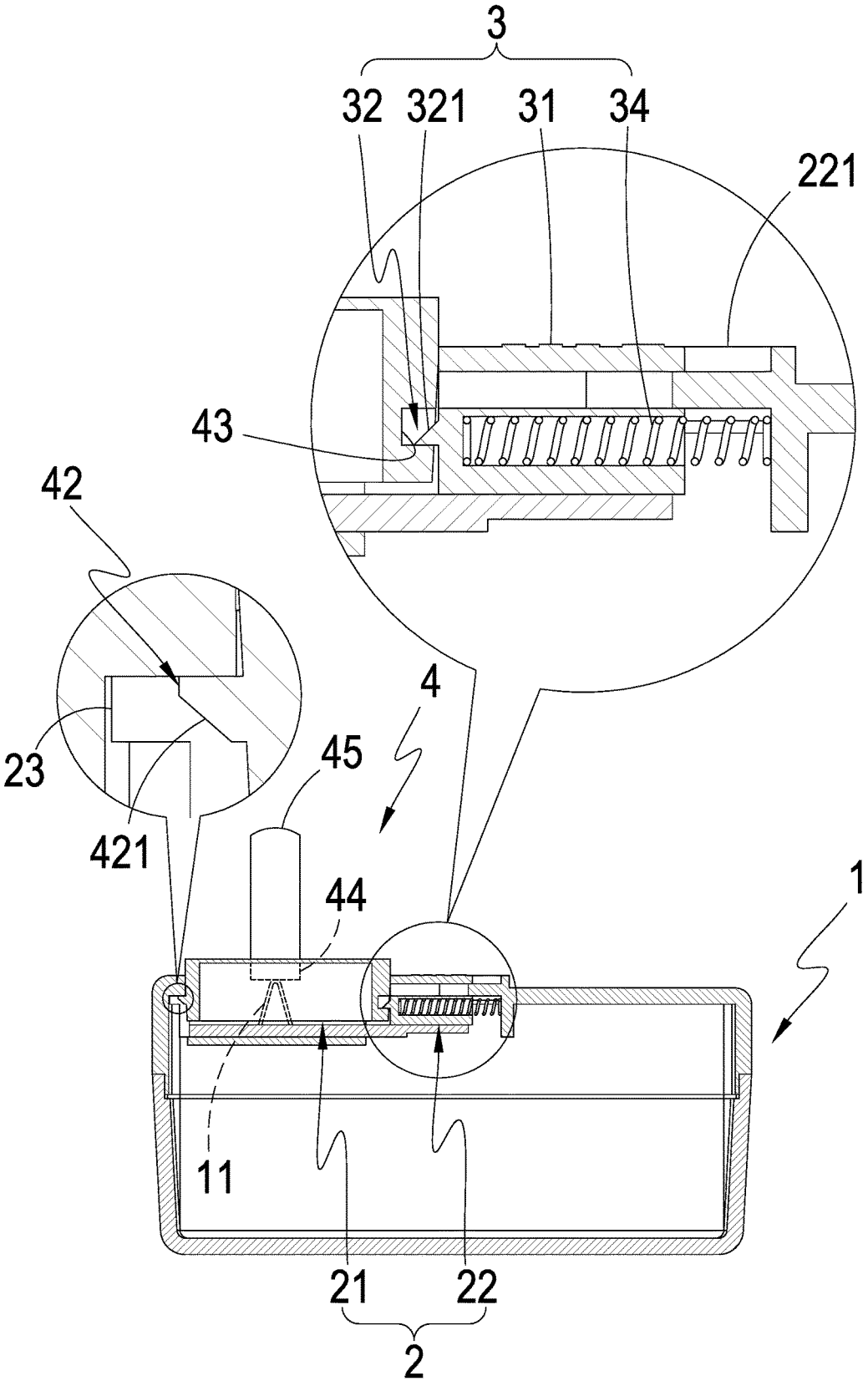
FIG. 2 is a cross-sectional view of the embodiment according to the present invention taken along line A-A of FIG. 1.
Figure 3:
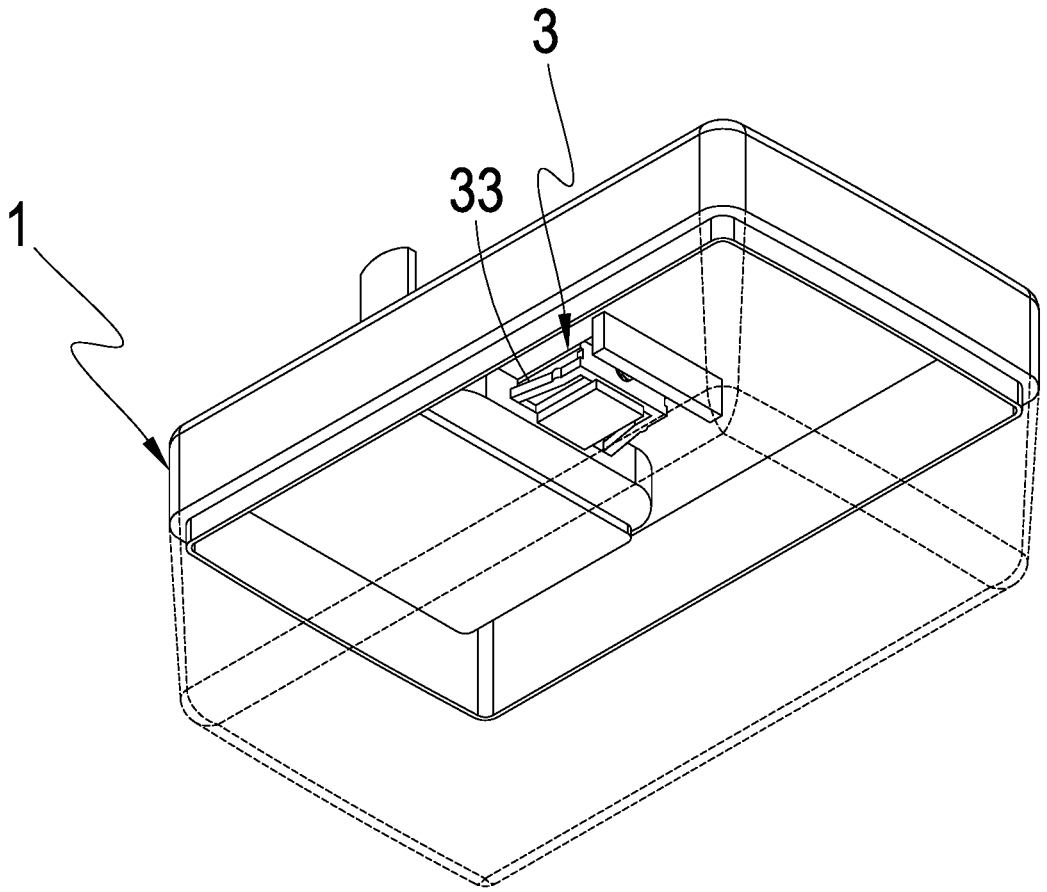
FIG. 3 is a see-through perspective view of the embodiment according to the present invention.
Figure 4:
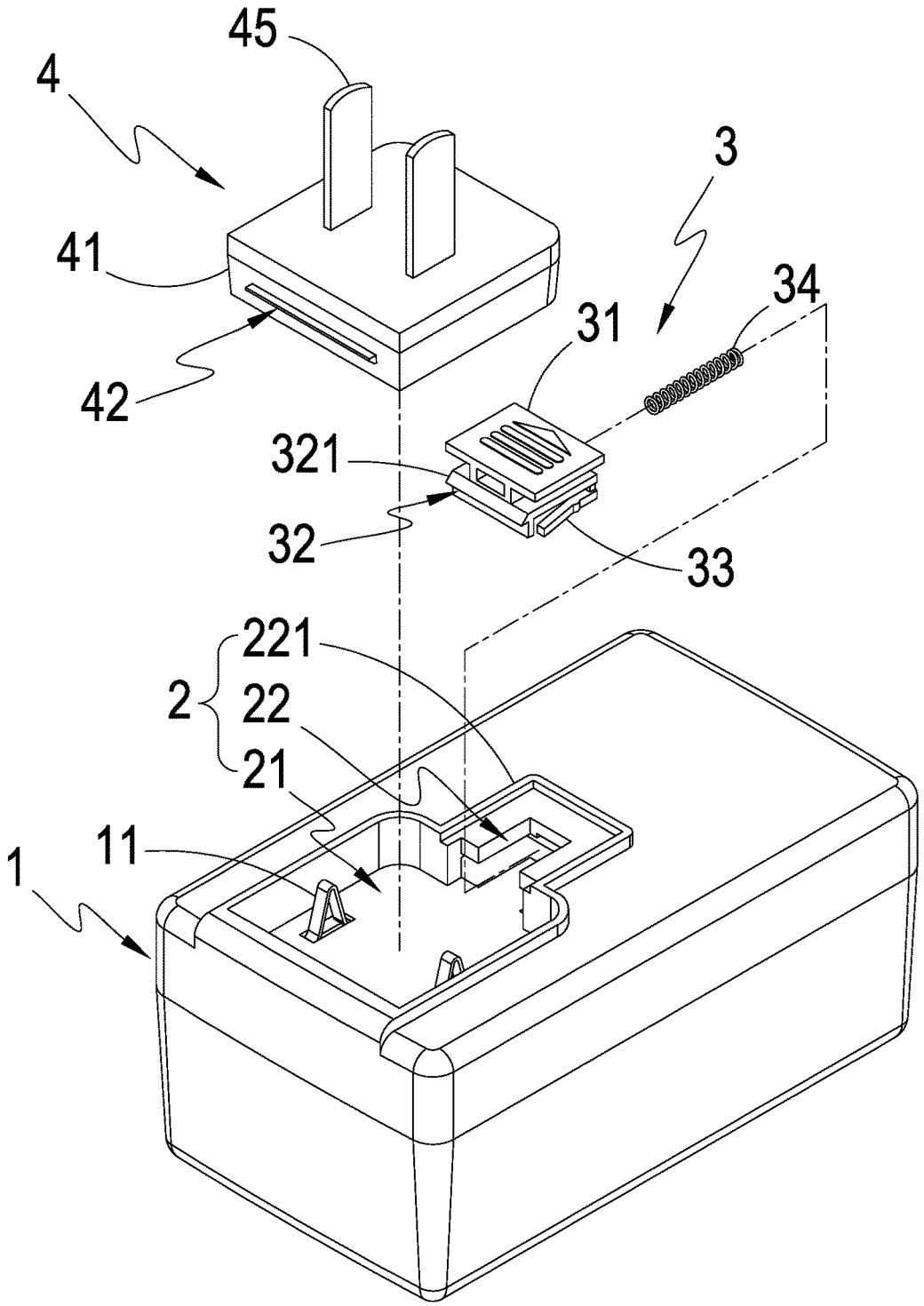
FIG. 4 is an exploded view of the embodiment according to the present invention.
Figure 4A:
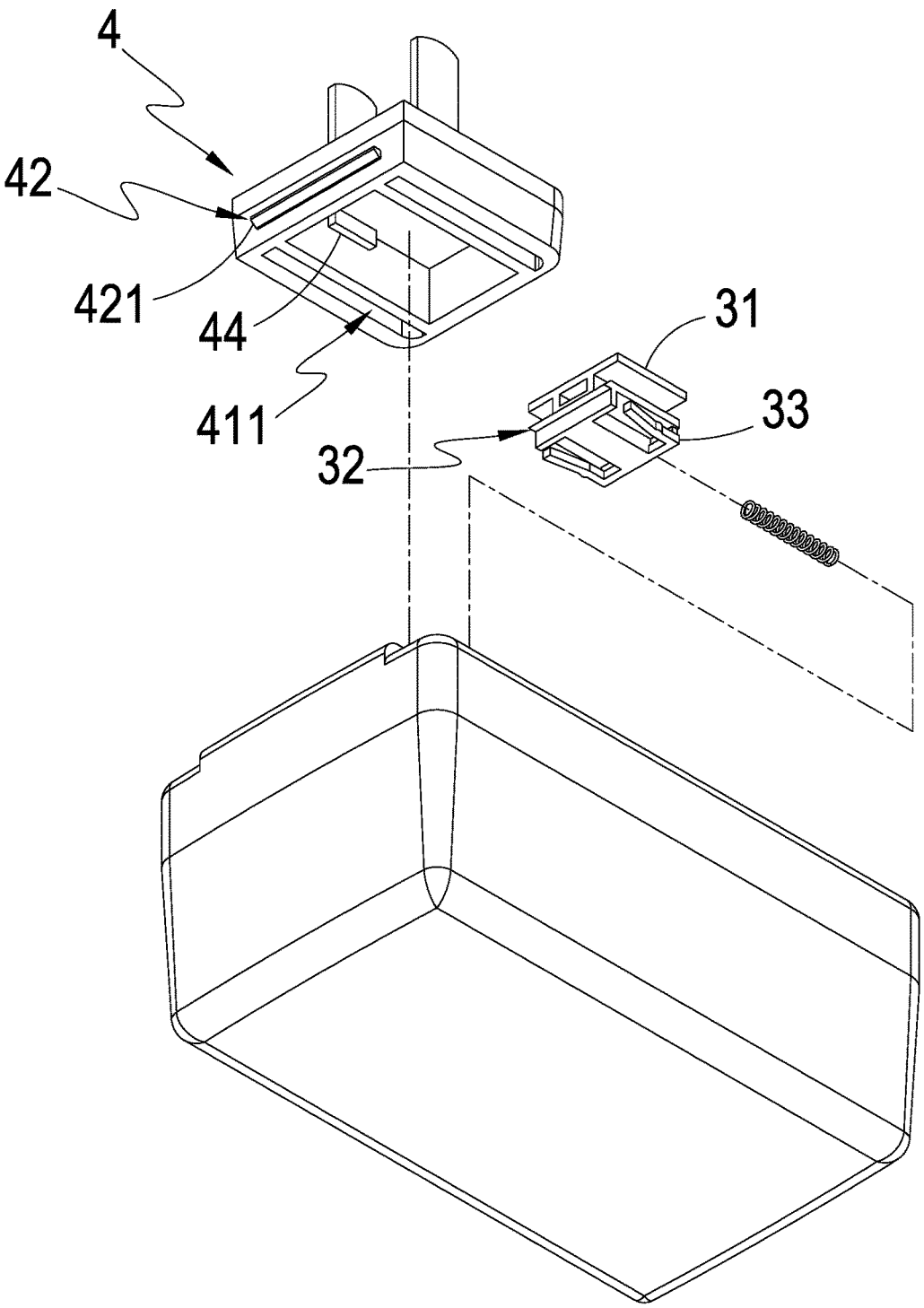
FIG. 4A is another exploded view of the embodiment according to the present invention.
Figure 5:
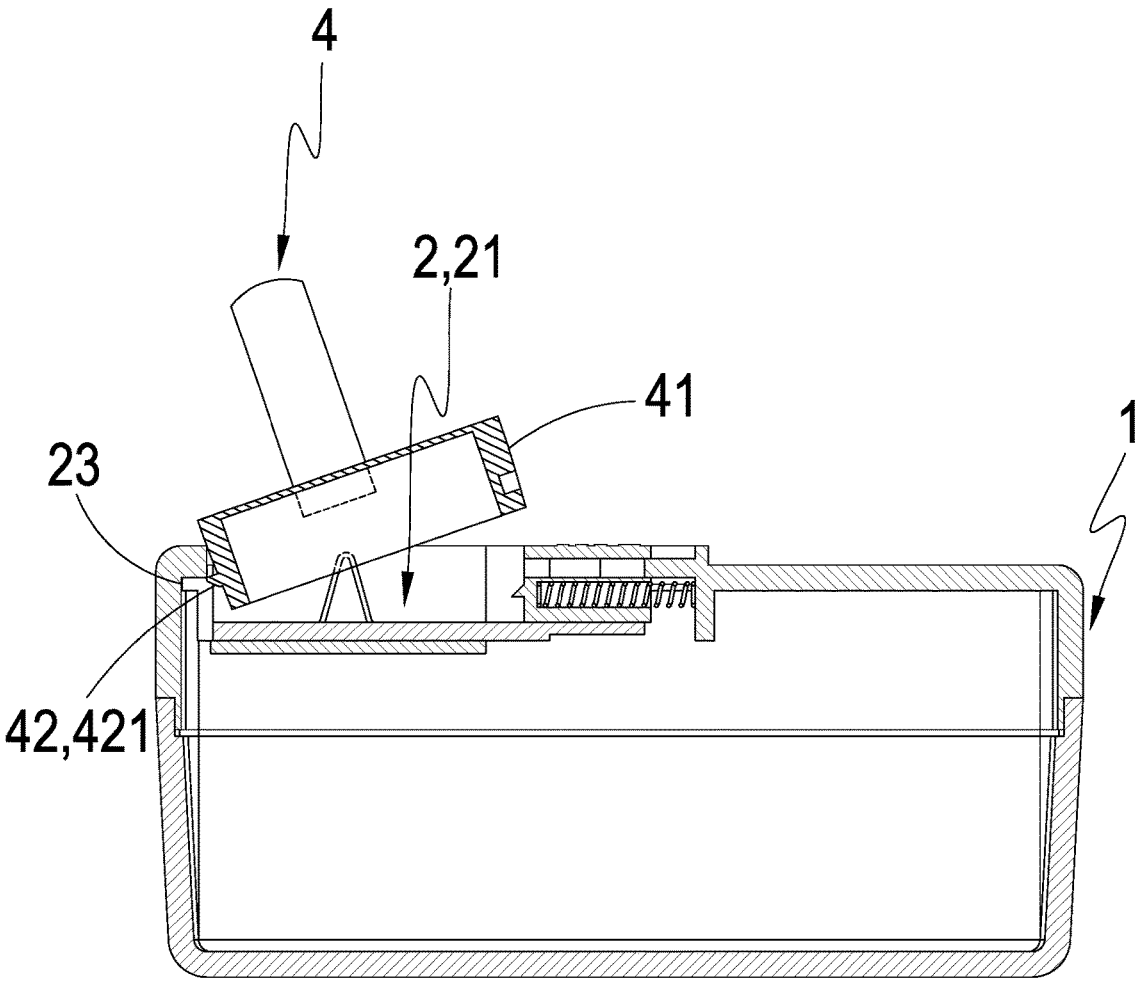
FIG. 5 shows the embodiment of the present invention in middle of combination.
Figure 6:
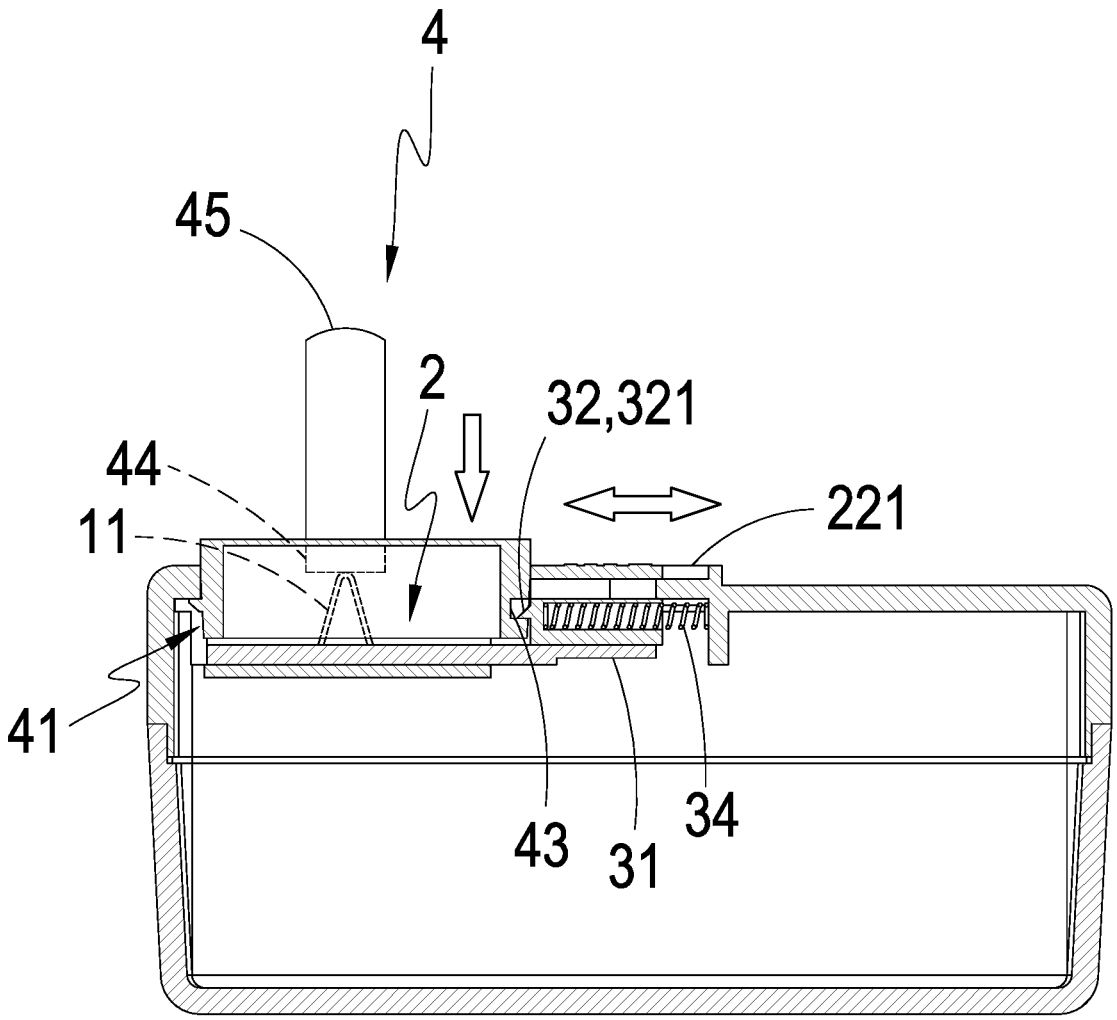
FIG. 6 shows the embodiment of the present invention upon engagement.
Figure 7:
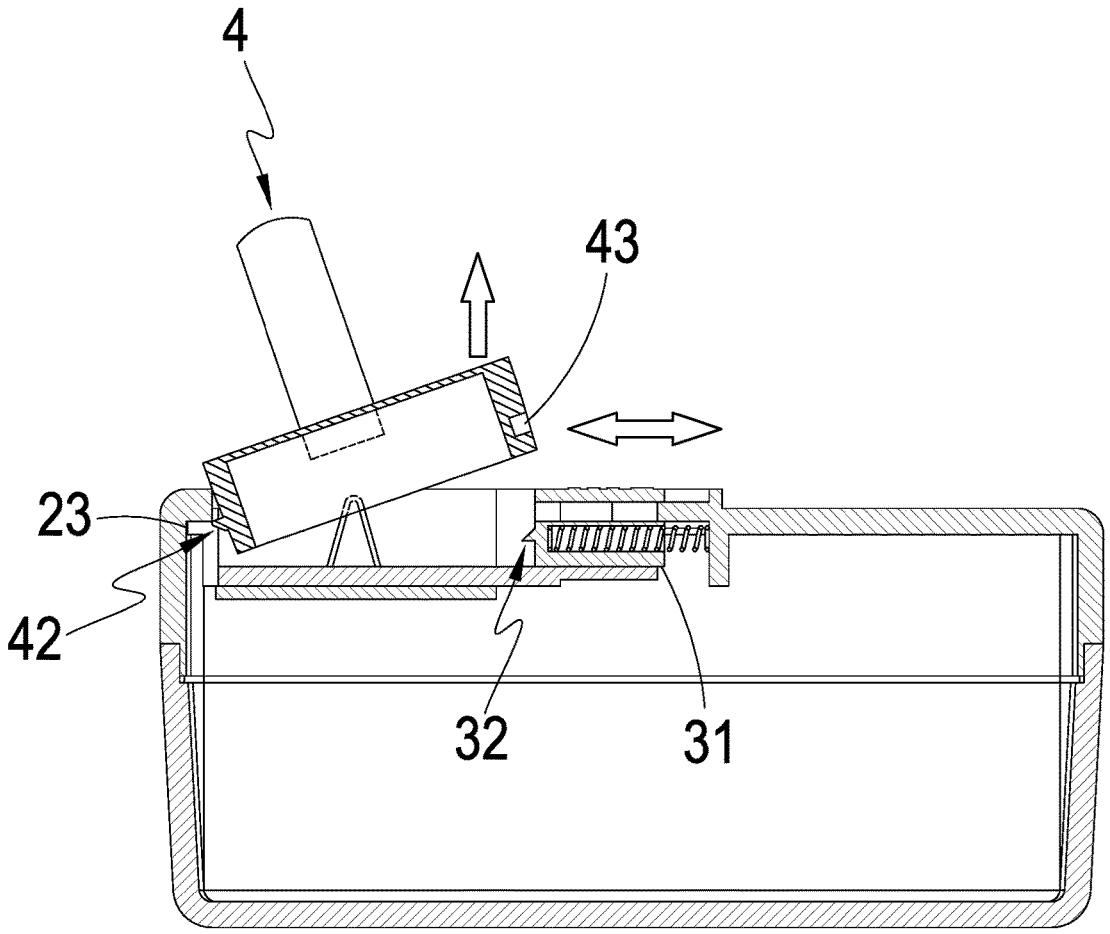
FIG. 7 shows the embodiment of the present invention upon separation.
Figure 8:
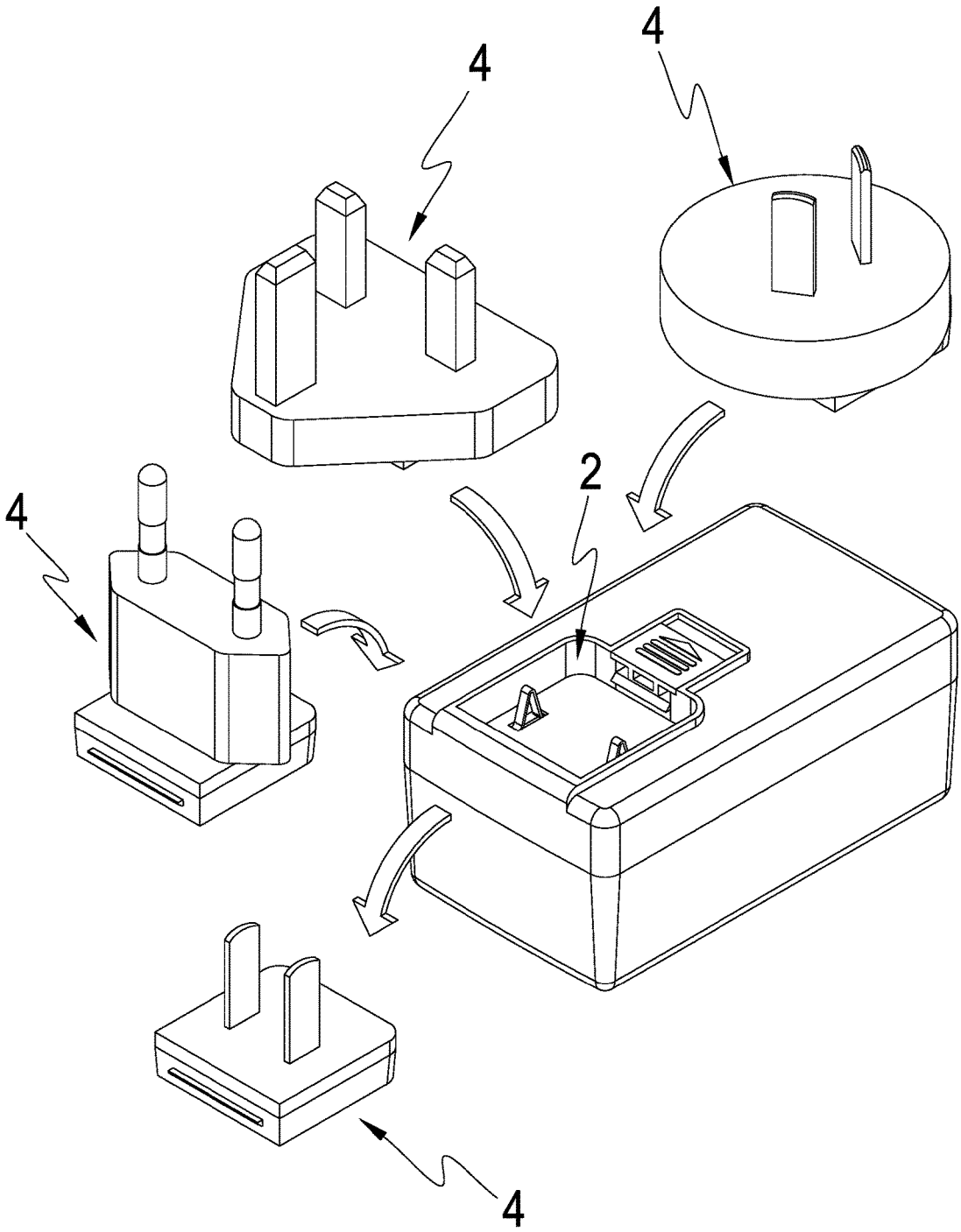
FIG. 8 shows the embodiment of the present invention upon replacement.

Referring to FIGS. 1 to 4A, which respectively are a schematically perspective view, cross-sectional view taken along line A-A of FIG. 1, see-through perspective view of the inside, exploded view, another exploded view of a preferred embodiment of the present invention, a pluggable power supply device of the present invention includes a power supply seat 1, accommodation portion 2, at least on first engagement portion 23, gripping device 3, at least one pluggable plug 4, insertion portion 41, at least one second engagement portion 42 and at least one second gripping portion 43.

The accommodation portion 2 is formed on one face of the power supply seat 1, and a plurality of conductive terminals 11 are configured inside the accommodation portion 2, where the accommodation portion 2 includes a mounting region 21 formed correspondingly to the insertion portion 41 for the assembly and disassembly of the plug 4 and a horizontal translation region 22 positioned on the edge of the mounting region 21 and allowing the horizontal translation of the gripping device 3. In addition, a limiting wall 221 formed correspondingly to the translation range of a sliding block 31, which will be described below, is configured in the horizontal translation region 22.

The first engagement portion 23 is formed on one inner side wall of the accommodation portion 2, and the gripping device 3 is movably mounted on the power supply seat 1 and includes the sliding block 31 mounted in a horizontal translation way in the accommodation portion 2 and positioned on another side of the accommodation portion 2 opposite to the engagement portion 23, at least one gripping portion 32 configured on one side of the sliding block 31 adjacent to the first engagement portion 23 and at least one elastic element 34 configured on another side of the sliding block 31 far away from the first gripping portion 32. Furthermore, at least one fixing elastic positioning portion 33 is configured on the sliding block 31, and a gripping inclined face 321 facilitating the gripping is formed on the first gripping portion 32. In the embodiment, the elastic element 34 is a spring, but the present invention is not so limited.

Furthermore, the insertion portion 41 is configured on one side of the pluggable plug 4 and formed correspondingly to the accommodation portion 2, where a plurality of conduction portions 44 each corresponding to one of the conductive terminals 11 are configured on one side of the pluggable plug 4 adjacent to insertion portion 41, and a plurality of transmission conductors 44 each in electric connection with one of the conduction portions 44 on another side thereof far away from the insertion portion 41, with at least one hollow section 411 corresponding to each conduction portion 44 being formed on the insertion portion 44. Furthermore, the second engagement portion 42 is configured on one side of the insertion portion 41 so as to allow the first engagement portion 23 to be engaged therewith, and formed with at least one engagement inclined face 421 adapted to facilitate the engagement. In addition, the second gripping portion 43 is formed on another side of the insertion portion 41 far away from the second engagement portion 42 allowing the first gripping portion 32 to be engaged therewith. The described above is only one of the implementation aspects of the present invention, but they are not so limited.

Referring to FIGS. 1 to 8, which respectively are a schematically perspective view, cross-sectional view taken along line A-A of FIG. 1, see-through perspective view of the inside, exploded view, another exploded view, schematically cross-sectional view in an insertion state, schematically cross-sectional view in an engagement state, schematically cross-sectional view in a disassembly state and schematically perspective view in a replacement state of the embodiment of the present invention, the sliding block 31 stays at a gripping position through the elastic positioning portion 33 and elastic element 34 operated in coordination with each other while not in a use state. When the pluggable plug 4 is to be in combination with the power supply seat 1, the insertion portion 41 is first inserted in the mounting region 21 of the accommodation portion 2, allowing the second engagement portion 42 to be engaged with the first engagement portion 23 smoothly with the aid of engagement inclined face 421, and the pluggable plug 4 is then pressed to cause the sliding block 31 to be translated horizontally from the gripping position to a separation position, causing the elastic element 34 to be deformed to store energy and drive the first gripping portion 32 to move. At the same time, the insertion portion 41 enters the accommodation portion 2 completely with the aid of the gripping inclined face 321, and the elastic element 34 is then released by the energy stored therein to recover back to its original shape and thereby to drive sliding block 31 to translate horizontally back to the gripping position, allowing the first gripping portion 32 to move back and be in engagement with the second gripping portion 43 smoothly with the aid of the gripping inclined face 321, thereby achieving the object of free and easy quick assembly of the pluggable plug 4 on the power supply seat 1.

In the process of the assembly, each conductive terminal 11 will be inserted in the hollow section 411 to be in contact with the corresponding conduction portion 44 for the subsequent power transmission through the transmission conductors 45. In addition, the sliding block 31 will be moved more smoothly and stably with the aide of the limiting wall 221 upon the horizontal translation thereof.

Furthermore, when the pluggable plug 4 is to be removed or replaced, the sliding block 31 is translated horizontally to the separation position, causing the first gripping portion 32 to be separated from the second gripping portion 43, and the second engagement portion 42 can then be separated from the first engagement portion 23 directly so that the pluggable plug 4 can be taken out quickly, freely and easily, thereby achieving the object of the free and easy, quick disassembly or replacement of the pluggable plug 4 from the power supply seat 1.

Therefore, if a user has a multi-country demand, they may replace a pluggable plug not conforming to required specifications with one conforming to the specifications and fixes it in the accommodation portion 2, thereby reducing the user cost and the volume of baggage.

The pluggable power supply device of the present invention has the following advantages compared with conventional ones:

1. the present invention can achieve the free and easy, quick disassembly and assembly to conform to power supply specifications through the first engagement portion 23, gripping device 2, second engagement portion 42 and second gripping portion 43 operated in coordination with each other;

2. the user cost can be reduced by matching the power supply seat 1 selectively with the pluggable plugs 4 of different specifications; and 3. the volume of baggage can be reduced and carrying it thus is more convenient through the selective matching of the power supply seat 1 with the pluggable plugs 4 of different specifications.

I claim:

1. A pluggable power supply device, comprising:

a power supply seat;

an accommodation portion, formed on one face of said power supply seat;

at least one first engagement portion, formed on one inner side wall of said accommodation portion;

a gripping device, movably configured on said power supply seat, and comprising a sliding block movable horizontally inside said accommodation portion and positioned on another side of said accommodation portion opposite to said first engagement portion, at least one first gripping portion configured on one side of said sliding block adjacent to said first engagement portion, and at least one elastic element configured on another side of said sliding block far away from said first gripping portion and located between said sliding block and said power supply seat to supply a basing force to said sliding block;

at least one pluggable plug, an insertion portion formed correspondingly to and detachably receivable into said accommodation portion being configured on one face thereof;

at least one second engagement portion, configured on one face of said pluggable plug and engageable with said first engagement portion; and at least one second gripping portion, formed on another side of said insertion portion far away from said second engagement portion, such that said second gripping portion is engaged with said first gripping portion when said insertion portion is received in said accommodation portion and said sliding block is positioned at a gripping position by being biased by the biasing force of said elastic element, and said first gripping portion is released from said second gripping portion when said sliding block is translated horizontally, through deformation of said elastic element, to a separation position to allow said insertion portion to be detached from said accommodation portion;

wherein at least one elastic positioning portion is configured on a side of said sliding block to set said sliding block at the gripping position.

2. The device according to claim 1, wherein at least one gripping inclined face adapted to facilitate the engagement between said first gripping portion and said second gripping portion at the gripping position is formed on said first gripping portion.

3. The device according to claim 1, wherein at least one engagement inclined face facilitating said engagement is formed on said second engagement portion.

4. The device according to claim 1, wherein said elastic element is a spring.

5. The device according to claim 1, wherein said accommodation portion comprises a mounting region formed correspondingly to said insertion portion, and a horizontal translation region positioned on an edge of said mounting region, in communication therewith and allowing said gripping device to be translated horizontally.

6. The device according to claim 5, wherein a limiting wall formed correspondingly to a translation range of said sliding block is configured inside said horizontal translation region.

7. The device according to claim 1, wherein said power supply seat is configured with a plurality of conductive terminals in said accommodation portion.

8. The device according to claim 7, wherein a plurality of conduction portions each corresponding to one of said conductive terminals are configured on one side of said pluggable plug adjacent to said insertion portion, and a plurality of transmission conductors each being in electric connection with one of said conduction portions are provided on another side of said pluggable plug far away from said insertion portion.

9. The device according to claim 8, wherein said insertion portion is configured with at least one hollow section formed correspondingly to each said conduction portion.

* * * * *